United States Patent [19]

Braselton

[11] Patent Number: 4,608,116

[45] Date of Patent: Aug. 26, 1986

[54] BASEBOARD EDGE TAPING TOOL

[76] Inventor: Keith Braselton, 2176 Allston Pl., Fairfield, Calif. 94533

[21] Appl. No.: 747,158

[22] Filed: Jun. 20, 1985

[51] Int. Cl.[4] ..... B32B 35/00

[52] U.S. Cl. ..... 156/523; 156/576; 156/577; 156/579

[58] Field of Search ..... 156/523, 526, 576, 577, 156/579, 574

[56] References Cited

U.S. PATENT DOCUMENTS

| | | | |
|---|---|---|---|
| 2,192,634 | 3/1940 | Blomquist | 156/523 |
| 2,235,704 | 3/1941 | Gorbatenko et al. | 156/526 |
| 2,328,571 | 9/1943 | Meyer | 156/526 |
| 2,493,502 | 1/1950 | Renne, Jr. | 156/526 |
| 2,493,737 | 1/1950 | Burns | 156/523 |
| 3,006,495 | 10/1961 | Miller | 156/526 |
| 3,131,109 | 4/1964 | Auld et al. | 156/526 |
| 3,374,139 | 5/1965 | Fritzinger | 156/523 |
| 3,389,040 | 6/1968 | Fritzinger | 156/523 |
| 3,404,060 | 10/1968 | Taylor, Jr. | 156/526 |
| 3,582,433 | 6/1971 | Rothenberger | 156/523 |
| 3,740,297 | 6/1973 | Vidinsky | 156/523 |
| 4,504,351 | 3/1985 | Antonson | 156/523 |

FOREIGN PATENT DOCUMENTS

| | | | |
|---|---|---|---|
| 872896 | 7/1961 | United Kingdom | 156/526 |

*Primary Examiner*—Michael Wityshyn

*Attorney, Agent, or Firm*—Townsend and Townsend

[57] ABSTRACT

A baseboard edge taping tool for applying tape to a baseboard edge and cutting the tape upon tilting the tool so that the cut can be placed in a corner and the tool can be used to continue applying tape to another baseboard edge without rethreading the tape. The taping tool has a base with a flat bottom surface for resting on the baseboard edge against which the masking tape is to be applied. A body portion is rotatably mounted to the base so that it can be rotated between a lowered position and a raised position. A spool is mounted to the body portion for holding a roll of masking tape which is fed over a roller at the front end of the body and across the bottom surface of the base. A second roller is mounted to the body adjacent the first roller to hold the tape against the first roller. A cutting mechanism is attached to the base and extends horizontally forward to cut the tape when the body is rotated. The rotation of the body lifts the first roller up and away from a corner.

10 Claims, 5 Drawing Figures

BASEBOARD EDGE TAPING TOOL

BACKGROUND OF THE INVENTION

The present invention relates to a device for applying adhesive tape to a flat surface, and more particularly, for applying masking tape to the edge of a baseboard.

One device for applying a roll of masking tape to a surface is shown in U.S. Pat. No. 2,493,737 to Burns. Burns shows a device for holding a roll of masking tape on a spool and applying the tape from the roll to a flat surface by means of a roller attached to the device. A blade located behind the roller is activated by tilting the device to extend the blade downward and cut the tape behind the roller.

U.S. Pat. No. 2,235,704 to Gorbatenko et al. shows another device for applying tape using two rollers with a cutting blade extending between the two rollers when the device is tilted to cut the tape. The cut edge of the tape cannot be placed on a baseboard in a corner of two walls using either the Burns or Gorbatenko devices because the blade is located behind the roller and the roller will get in the way by contacting the wall at the corner. The blade in each case cuts the tape behind the roller.

A taping device which is effective at placing the cut of the tape at a corner is shown in U.S. Pat. No. 3,740,297 to Vidinsky. Vidinsky has a nosewhich extends beyond the first and second rollers and over which the masking tape must pass. The Vidinsky device can be pushed until the nosepiece contacts the corner and at that point a lever is manipulated to force a cutting blade through a slot in the nosepiece to cut the tape. However, the masking tape must be rethreaded over the nosepiece and the second roller behind the nosepiece before the device can be used to continue placing masking tape on another surface.

SUMMARY OF THE INVENTION

The present invention is a baseboard edge taping tool for applying tape to a baseboard edge and cutting the tape upon tilting the tool so that the cut can be placed in a corner and the tool can be used to continue applying tape to another baseboard edge without rethreading the tape. The taping tool has a base with a flat bottom surface for resting on the baseboard edge against which the masking tape is to be applied. A body portion is rotatably mounted to the base so that it can be rotated between a lowered position and a raised position. A spool is mounted to the body portion for holding a roll of masking tape which is fed over a roller at the front end of the body and across the bottom surface of the base. A second roller is mounted to the body adjacent the first roller to hold the tape against the first roller. A cutting mechanism is attached to the base and extends outward to cut the tape when the body is rotated. The rotating of the body lifts the first roller up and away from a corner. The unique combination of a horizontally extending cutting blade and a roller which rotates out of the way allows for the tape to be placed and cut in a corner.

When the taping tool reaches a corner, the first roller contacts the corner but lifts upward and backward as the taping tool is tilted. At the same time, the cutting blade extends horizontally outward beneath the roller until it reaches the corner and cuts the tape. The tape remains threaded between the first and second rollers after the cut, allowing the tape to be immediately applied to another baseboard edge without rethreading.

Preferably, the cutting mechanism includes a blade within a housing with the housing extending outward to push the tape into the corner, at which point the blade then extends from the housing to cut the tape. The cutting mechanism is angled downward relative to the base so that the tape is cut when it is approximately at the level of the baseboard to which it is being applied. The taping tool has a handle attached to the body so that it can be easily used by a person without stooping. The use of the rotation of the body to cut the tape eliminates the need for a user to stoop down to manipulate a lever or other device to activate the cutting blade.

For a fuller understanding of the nature and advantages of the invention, reference should be made to the ensuing detailed description taken in conjunction with the accompanying drawings.

DETAILED DESCRIPTION OF THE PREFERRED EMBODIMENT

Figure 1:
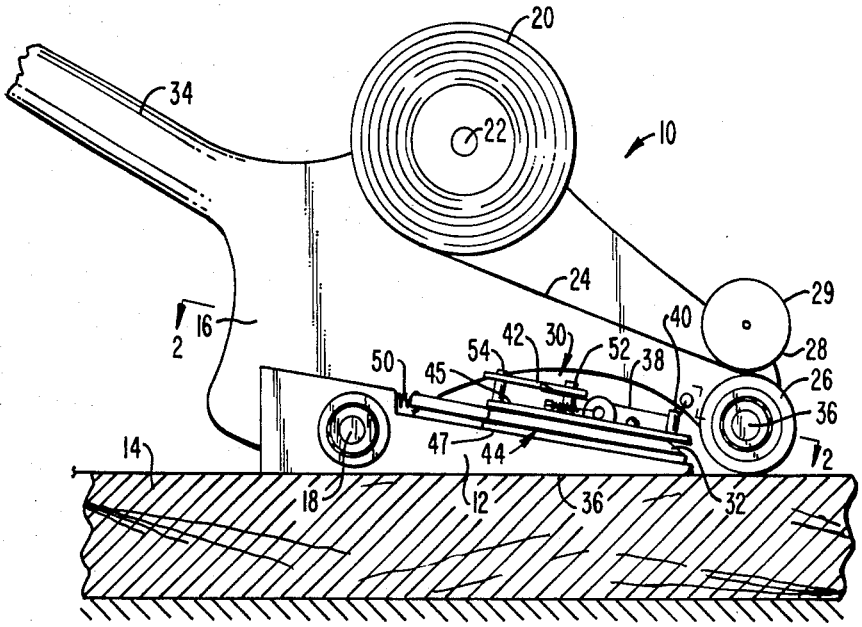
FIG. 1 is a side view of a preferred embodiment of the taping tool of the present invention.

FIG. 1 shows a preferred embodiment of the taping tool 10 of the present invention. A base 12 rests on a baseboard 14 to which tape is to be applied. A body portion 16 is rotatably coupled to base 12 by an axle 18. A roll of tape 20 is mounted on a spool 22 on body 16. A strip of masking tape 24 from roll 20 passes across a roller 26 and onto baseboard 14 beneath base 12. A second roller 28 holds masking tape 24 against roller 26. Roller 28 contacts tape 24 only with thin ridges 29 to prevent the tape from sticking to roller 28. A cutting mechanism 30 having a blade 32 is mounted on base 12. A handle 34 allows taping tool 10 to be easily manipulated by a user.

In operation, roll 20 is placed on spool 22 and masking tape 24 is threaded between rollers 26 and 28 and across a bottom surface 36 of base 12. The tool is pushed along baseboard 14 using handle 34, causing tape 24 to be applied to baseboard 14 and unwinding the tape from spool 20 with roller 26 rotating about axle 36. When a corner is reached and the tape is desired to be cut, handle 34 is tilted downward until taping tool 10 assumes the position shown in FIG. 1A. As can be seen from FIG. 1A, as handle 34 is tilted downward, the end of body 16 opposite handle 34 tilts upward, thereby pulling a cable 38. Cable 38 is threaded through a pulley 40 and attached to a lever arm 42. Lever arm 42 is coupled to a blade housing 44 and causes blade housing 44 to extend outward until it is prevented from extending further by a pair of stops (not shown). Lever arm 42 then causes blade 32 to extend outward to cut masking tape 24.

Figure 1A:
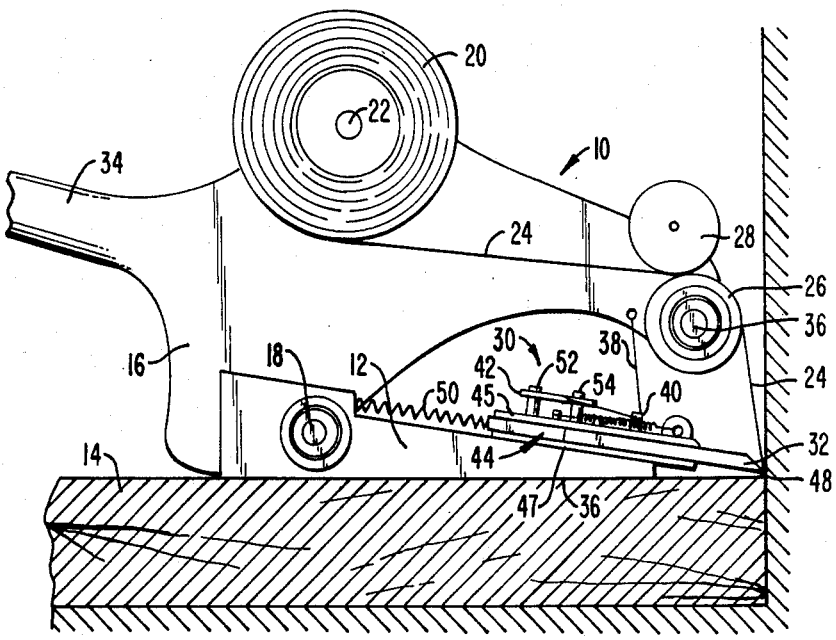
FIG. 1A is a side view of the taping tool of FIG. 1 with the body rotated back and the cutting mechanism extended.

Thus, tool 10 will apply tape 24 along a baseboard up to a corner 48. At that point tool 10 is tilted, moving roller 26 out of the way, and extending housing 44, which pushes the tape into the corner without cutting the tape. Blade 46 is then extended slightly beyond housing 44 to cut tape 24 precisely in corner 48. The extension of the blade in FIG. 1A is exaggerated for clarity.

As can be seen, when handle 34 is tilted upward again, housing 44 and blade 46 are retracted by a spring 50 and tape 24 remains threaded between roller 26 and roller 28 so that it may be applied to another baseboard without rethreading.

Figure 2:
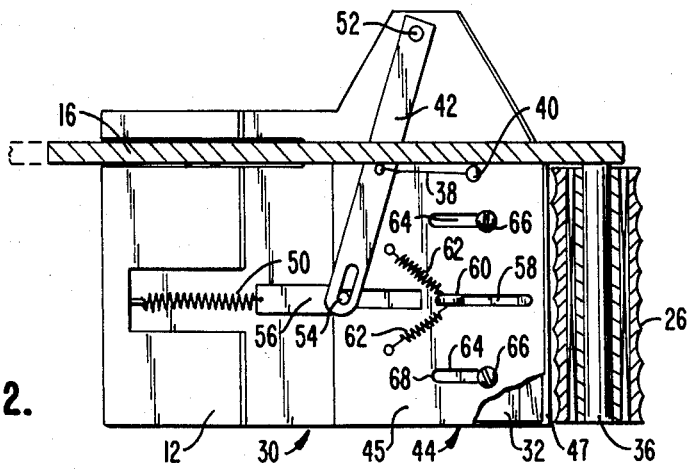
FIG. 2 is a top view of the cutting mechanism of FIG. 1.

FIG. 2 is a top view of the cutting mechanism 30 of FIG. 1. A lever arm 42 is attached to base 12 at a pivot point 52. Lever arm 42 is attached by a pin 54 to a handle 56 of blade 32. Blade 32 is sandwiched between a top plate 45 and a bottom plate 47 of housing 44. Plate 45 has a slot 58 for engaging a knob 60 attached to blade 32. Knob 60 is attached to housing 44 via a pair of springs 62. Both plates 45 and 47 of housing 44 have a pair of slots 64 for retaining a pair of knobs 66 attached to base 12.

Figure 2A:
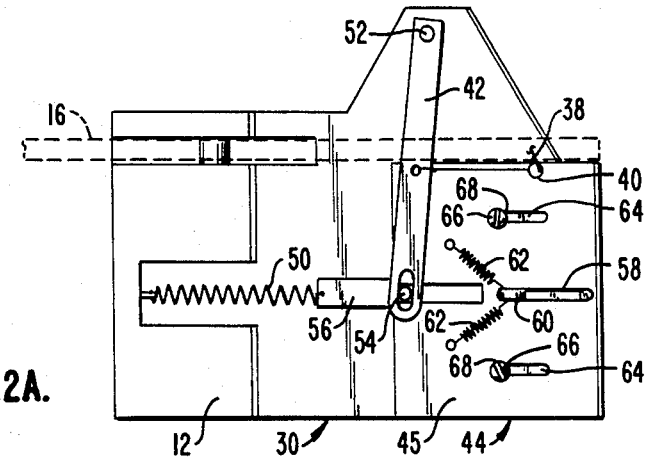
FIG. 2A is a top view of the cutting mechanism of FIG. 2 with the cutting housing partially extended.
Figure 2B:
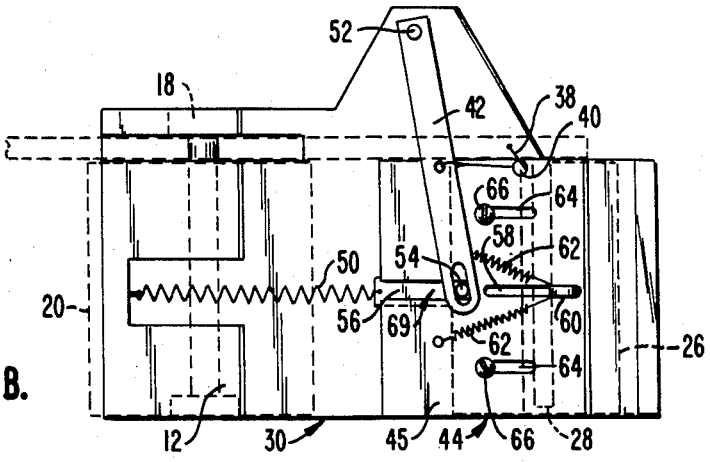
FIG. 2B is a top view of the cutting mechanism of FIG. 2 with the cutting blade fully extended.

The operation of cutting mechanism 30 can be seen with reference to FIGS. 2A and 2B. As handle 34 of FIG. 1 is tilted downward, wire 38 is pulled upward, thereby pulling lever arm 42 towards pulley 40. When lever arm 42 is pulled it forces handle 56 and blade 32 to the right. Spring 62 pulls along housing 44 with blade 32 until knobs 66 contact a left end 68 of slots 64. At this point, as shown in FIG. 2B, knobs 66 prevent further movement of housing 44 and handle 56 and blade 32 move further outward, thereby stretching springs 62. A slot 69 in plate 45 allows pin 54 to extend ¼ inch into plate 45 to extend blade 32. Blade 32 is thus projected outward from housing 44 to cut masking tape 24.

When handle 34 is tilted upward again, wire 38 is relaxed, allowing spring 50 to pull blade 32 back to its original position. As handle 56 is pulled backward, springs 62 relax, thereby pulling blade 32 back into housing 44 and pulling housing 44 back up to its original position. A serrated edge is preferred for blade 32 because this enables tape 24 to be cut without requiring as much extension of blade 32 as would be required with a straight edge.

Cutting mechanism 30 thus allows housing 44 to be extended until it contacts tape 24 and then pushes tape 24 into the corner without cutting the tape. At this position the movement of the housing 44 is prevented by knobs 66 and blade 32 extends further outward to cut tape 24 in the corner. Upon release of handle 34, cutting mechanism 30 returns to its original position and the tape can be applied to another surface and the cutting procedure duplicated.

As will be understood by those familiar with the art, the present invention may be embodied in other specific forms without departing from the spirit or essential characteristics thereof. For example, a number of coupled rods could be used, rather than cable 38, to extend cutting mechanism 30. Alternately, a straight edge cutting blade 46 could be used rather than the serrated edge shown above. Accordingly, the disclosure of the preferred embodiment of the present invention is intended to be illustrative, but not limiting of the scope of the invention which is set forth in the following claims.

What I claim is:

1. A masking tape applicator for applying a roll of masking tape to a subject surface, comprising:

a base having a flat bottom surface for resting on said subject surface;

a body rotatably mounted to said base, said body being rotatable between a first position and a second position;

a spool rotatably mounted to said body proximate a rear end of said body forming a holder for the roll of masking tape;

a first roller rotatably mounted to said body proximate a front end of said body opposite said rear end, said first roller having an edge in approximately the same plane as said bottom of said base when said body is in said first position, said first roller being movable upwardly and rearwardly as said body rotaters from said first to said second position;

a second roller rotatably mounted to said body adjacent said first roller for holding the masking tape against said first roller when said masking tape is extended from said spool across said first roller; and a cutting means, movably mounted to said base between said rear and front ends of said body, for cutting a portion of said masking tape extending from said first roller to said bottom surface of said base, said cutting means being coupled to said body such that it extends horizontally forward away from said rear end of said body when said body is rotated from said first position to said second position.

2. The applicator of claim 1 further comprising a handle extending from said rear end of said body.

3. The applicator of claim 2 wherein said handle is an integral part of said body.

4. The applicator of claim 1 wherein said cutting means comprises:

a blade housing movably mounted to said base and coupled to said body, such that said blade housing extends away from said rear end of said body when said body is rotated from said first position to said second position, whereby said blade housing when extended contacts said portion of the masking tape extending from said first roller to said bottom surface of said base; and a cutting blade enclosed in said housing and extendible from said housing to cut said portion of the masking tape after said blade housing contacts said portion of the masking tape.

5. The applicator of claim 4 further comprising:

a lever arm pivotably mounted to said base at a first end of said lever arm, a second end of said lever arm being coupled to said blade;

a pin mounted to said base proximate said front end of said body and defining an aperture;

a cable coupled to said body proximate said front end of said body, said cable extending through said aperture in said pin and being attached to said lever arm at a position removed from said first end of said lever arm;

first biasing means coupling said cutting blade to said blade housing;

stop means for stopping the extending movement of said blade housing after said blade housing contacts said portion of the masking tape extending from said first roller to said bottom surface of said base; and second biasing means for coupling said lever arm to said base.

6. The applicator of claim 5 further comprising a pulley disposed in said aperture in said pin for guiding said cable.

7. The applicator of claim 4 wherein said blade housing and blade are mounted at an angle to said bottom surface of said base so that, when extended, said blade will cut the masking tape in approximately the same plane as said bottom surface.

8. The applicator of claim 4 wherein said blade has a serrated edge.

9. The applicator of claim 1 wherein said spool is adjustable to accommodate varying widths of said roll of masking tape.

10. A masking tape applicator for applying a roll of masking tape to a subject surface, comprising:

a base having a flat bottom surface for resting on said subject surface;

a body rotatably mounted to said base, said body being rotatable between a first position and a second position;

a spool rotatably mounted to said body proximate a rear end of said body forming a holder for the roll of masking tape;

a handle extending from said rear end of said body;

a first roller rotatably mounted to said body proximate a front end of said body opposite said rear end, said first roller having an edge in approximately the same plane as said bottom of said base when said body is in said first position, said first roller being movable upwardly and rearwardly as said body rotates from said first position to said second position;

a second roller rotatably mounted to said body adjacent said first roller for holding the masking tape against said first roller when said masking tape is extended from said spool across said first roller;

a blade housing movably mounted to said base and coupled to said body, such that said blade housing extends horizontally forward away from said rear end of said body when said body is rotated from said first position to said second position, whereby said blade housing when extended contacts said portion of the masking tape extending from said first roller to said bottom surface of said base; and a cutting blade enclosed in said housing and extendible from said housing to cut said portion of the masking tape after said blade housing contacts said portion of the masking tape.

* * * * *